US005743520A

United States Patent [19]

Barthold

[11] Patent Number: 5,743,520

[45] Date of Patent: Apr. 28, 1998

[54] APPARATUS FOR STACKING INDIVIDUALLY FED-IN SHEETS

[75] Inventor: Ulrich Barthold, Baltmannsweiler-Hohengehren, Germany

[73] Assignee: Eastman Kodak Company, Rochester, N.Y.

[21] Appl. No.: 769,017

[22] Filed: Dec. 18, 1996

[30] Foreign Application Priority Data

Dec. 20, 1995 [DE] Germany ..... 195 47 669.7

[51] Int. Cl.[6] ..... B65H 31/26

[52] U.S. Cl. ..... 271/189; 271/220; 271/207; 271/314

[58] Field of Search ..... 271/189, 207, 271/245, 246, 215, 220, 223, 314

[56] References Cited

U.S. PATENT DOCUMENTS

| | | | |
|---|---|---|---|
| 3,918,701 | 11/1975 | Lee . | |
| 4,056,264 | 11/1977 | Dhooge et al. | 271/177 |
| 4,345,754 | 8/1982 | Willenbring | 271/220 |
| 4,838,539 | 6/1989 | Zimmermann | 271/220 |
| 4,898,374 | 2/1990 | Vermaat | 271/223 |
| 5,007,797 | 4/1991 | Munz . | |
| 5,033,731 | 7/1991 | Looney | 271/207 |
| 5,120,046 | 6/1992 | Mandel et al. . | |
| 5,284,337 | 2/1994 | Ettischer et al. . | |
| 5,524,877 | 6/1996 | Weber | 271/220 |

FOREIGN PATENT DOCUMENTS 1 303 445 11/1965 Germany .

OTHER PUBLICATIONS

Jobe et al, Document Exit Tray, IBM Technical Disclosure Bulletin, vol. 15, No. 7 p. 2194.

*Primary Examiner*—H. Grant Skaggs
*Attorney, Agent, or Firm*—Lawrence P. Kessler

[57] ABSTRACT

The apparatus according to the invention comprises a collector bin (2) for fed sheets (5) that is made up of a sheet support (4) and a sheet stop (12). A retaining apparatus (8) for the fed sheets (5) is provided facing the sheet support (4), and a stop finger (10) can be pivoted into the paper path. A jogger wheel (6), with which the fed sheets (5) can be transported toward the sheet stop (6), is installed above the sheet support (4) rotatably about a shaft (A). A holding element (14) for the stop finger (10) can be moved on the shaft (A) independently of the rotary movement of the jogger wheel (6), and a stopgap closure element (16) is also arranged on the holding element (14) in such a way that the stop finger (10) or the stopgap closure element (16) can be introduced into the paper path.

6 Claims, 1 Drawing Sheet

APPARATUS FOR STACKING INDIVIDUALLY FED-IN SHEETS

BACKGROUND OF THE INVENTION

The invention relates to an apparatus for stacking individually fed sheets, comprising a collector for the fed sheets that is made up of a sheet support and a sheet stop, a retaining apparatus for the fed sheets arranged facing the sheet support, and a stop finger that can be pivoted into the paper path.

In the paper collection region of a copier or an auxiliary unit, for example a stapler, the incoming sheets are deposited in stacked fashion. A paper hold-down apparatus and a jogger are provided in order to obtain as organized a stack as possible. Matching between the feed force of the jogger and the downward force of the paper hold-down apparatus is possible only within a narrow range in order to prevent damage to the fed sheets. When a complete stack is removed from the paper collection region, a stop finger pivots into the paper path behind the jogger wheel in order to collect the new sheets being fed in that are transported into the paper collection region during removal of the complete paper stack. Several apparatuses that have a stop finger, a hold-down for the sheet stack, or a sheet guide downstream from the jogger, are known from the prior art. U.S. Pat. No. 5,007,797 discloses an apparatus for depositing sheets in a collector bin, and a retaining apparatus that can be brought into the collector bin. A stepping motor pivots a separating finger onto the top of the stack; this separates the next incoming sheet from the sheet stack located below it, and the complete stack can be removed from the collector bin.

An apparatus for depositing sheets in a stack is disclosed in DE-A-13 03 445. The sheets are aligned at an edge that is configured such that it can be moved away. A gripper grips the stack of sheets so as to convey it for further processing. A separating shoe can be pivoted in onto the sheet stack, and acts as an auxiliary stop for the additional incoming sheets. The sheets that come in after the separating shoe is pivoted in are thus effectively separated from the previously organized sheet stack, which is removed from the collector apparatus.

U.S. Pat. No. 5,284,337 discloses an apparatus for depositing sheets in a collector bin. A hold-down rests under its own weight on the organized stack, and is arranged so that it pivots back when the cover is open, so as not to be damaged by the stapler.

U.S. Pat. No. 5,120,046 describes a sheet deposition apparatus in which sheet alignment is enhanced by a rotatable jogger wheel and a so-called "ski". The jogger wheel and the ski move as a function of stack height. The ski is intended to prevent buckling or arching of sheets just arriving onto the sheet stack.

U.S. Pat. No. 3,918,701 discloses a paper deposition tray that comprises a deflection apparatus for incoming sheets. The deflection apparatus consists of a curved component that is articulated pivotedly onto a shaft. The deflection apparatus is configured such that it has almost no influence on the speed of the incoming sheets.

SUMMARY OF THE INVENTION

It is the object of the invention to provide an apparatus with which a wide range of paper types can be processed without damage or paper jamming. In addition, no laborious adjustment operations are to be required if the paper type in the processing apparatus is changed.

A further object of the invention is a simple structure for the apparatus, without additional drives and control systems.

In accordance with the invention, this object is attained in that a jogger wheel, with which fed sheets can be transported toward the sheet stop, is arranged above the sheet support for rotation about a shaft; and that a holding element for the stop finger can be moved on the shaft independently of the rotary movement of the jogger wheel; and that a stopgap closure element is also arranged on the holding element in such a way that the stop finger or the stopgap closure element can be introduced into the paper path.

The advantage of the apparatus according to the invention is that a stopgap closure element is provided which can be brought, by rotation of the holding element, into the region between the jogger wheel and the oblique surface of a second part of a retaining apparatus. In the process, the free end of the stopgap closure element is displaced to a point just in front of the retaining apparatus. As a result, the sheet just fed in can be arched up by the jogger feed only to the height of the stopgap closure element. The angle of incidence onto the bevel of the retaining apparatus is thus also reduced, so that paper jamming cannot occur. In addition, because of the lesser height and the upper limitation on arching, substantially greater jogger feed forces can be used, even with thin papers. Thus the downward force of the retaining apparatus can also be raised, which therefore allows a substantially greater working range for formation of a neat stack, even with thick and curved papers. Moreover the design of the apparatus is particularly simple, since the holding element, along with the drive for the stop finger, is provided on the shaft for the jogger wheel. The holding element additionally carries the stopgap closure element. The stop finger is pivoted into the paper path by means of a clockwise rotary movement of the holding element, and the stopgap closure element is slid into the region between the jogger wheel and the retaining apparatus with a counter-clockwise rotary movement of the holding element.

Further advantageous embodiments of the invention are evident from the claims.

BRIEF DESCRIPTION OF THE DRAWINGS

The subject matter of the invention will be described with reference to the embodiment illustrated the drawing in which.

DETAILED DESCRIPTION OF THE INVENTION

Figure 1:
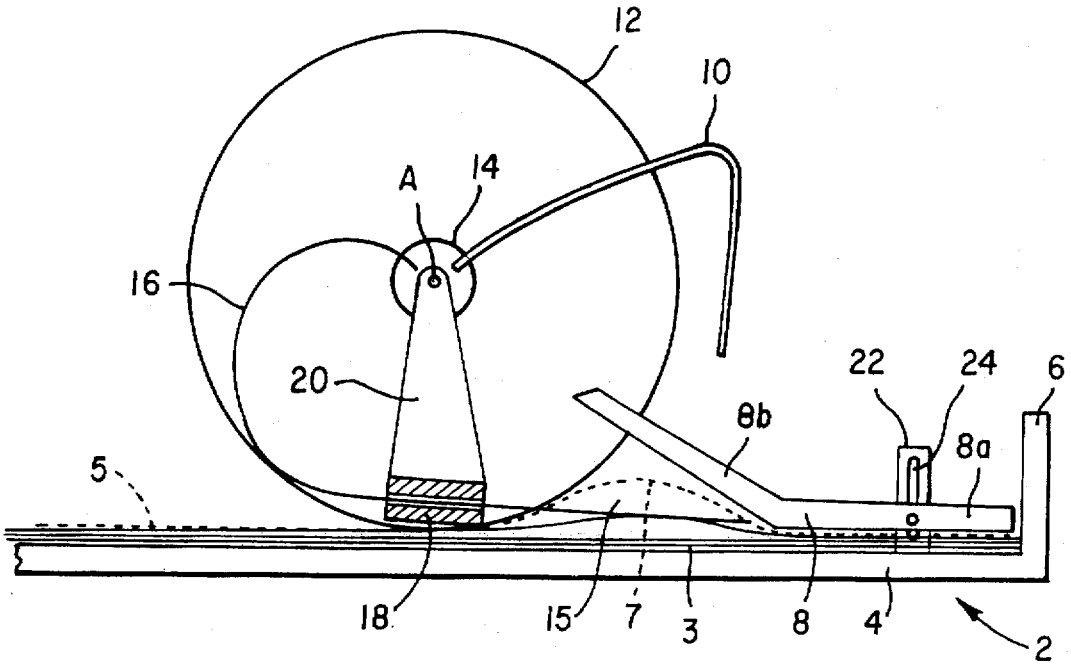
FIG. 1 shows a schematic construction of the apparatus according to the invention in which the stop finger is pivoted out of the paper path.
Figure 2:
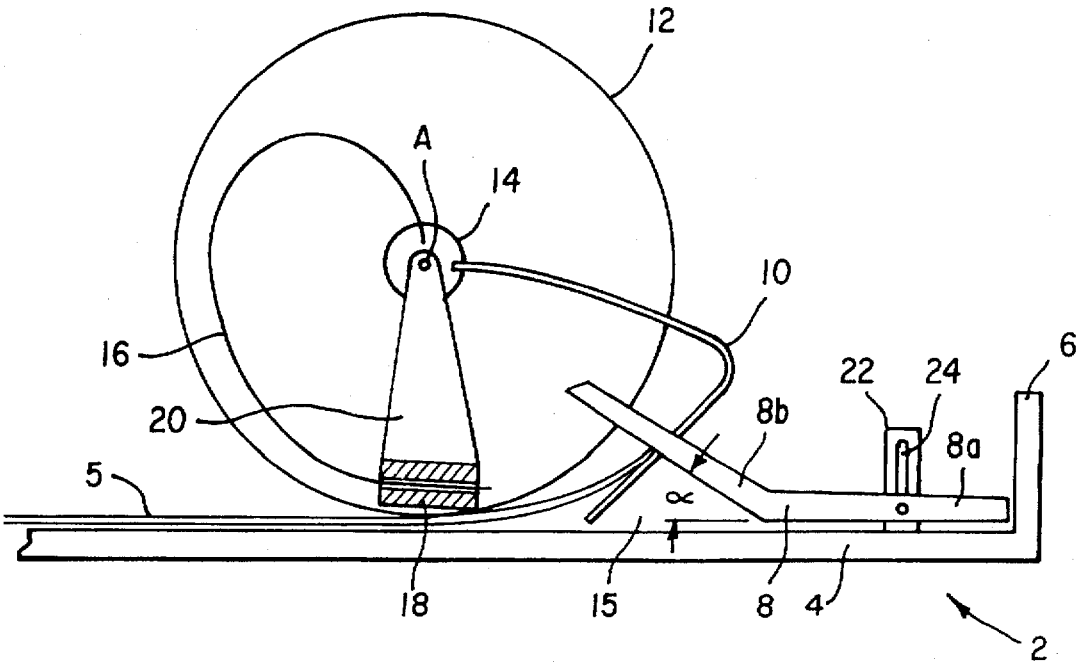
FIG. 2 shows a schematic construction of the apparatus according to the invention in which the stop finger is pivoted into the paper path.

The apparatus according to the invention is shown schematically in FIGS. 1 and 2. From the depiction, it is clear to any person skilled in the art how the apparatus according to the invention is to be realized and how it functions.

A collector bin 2 serves to receive a sheet stack 3. Collector bin 2 consists substantially of a sheet support 4 on which individually fed sheets 5 are assembled into an organized sheet stack 3. In addition a sheet stop 6, against which the individually fed sheets 5 are aligned, is shaped at the end of sheet support 4. Arranged above sheet support 4 is a jogger wheel 12, rotatable about a shaft A, that grasps the fed sheets 5 and conveys them against sheet stop 6. Also provided on shaft A is a holding element 14 for a stop finger 10 and a stopgap closure element 16. Holding element 14 is rotatable, both clockwise and counter-clockwise, independently of the rotary movement of jogger wheel 12. To guide stopgap closure element 16, a guide element 18 is attached on a retainer 20 in such a way that the portion of stopgap closure element 16 projecting out of guide element 18 is only slightly inclined with respect to sheet support 4 (almost parallel to the sheet support).

To produce an organized sheet stack 3, a retaining apparatus 8 is provided that is mounted on a mounting element 22 in such a way that retaining apparatus 8 can be moved vertically, in a slot 24, away from sheet support 4 or toward sheet support 4. The distance between retaining apparatus 8 and sheet support 4 increases with increasing thickness of sheet stack 3 that is being organized. Retaining apparatus 8 rests with a certain downward force on the topmost sheet of sheet stack 3. Retaining apparatus 8 consists of a first part **8*a* that is substantially parallel to sheet support 4. A second part 8*b* is shaped at the end of the first part facing away from sheet stop 6. Second part 8*b* encloses an acute angle $\alpha$ with sheet support 4 (see FIG. 2). The oblique surface formed by second part 8*b* of retaining apparatus 8 forces sheets that have just been fed in beneath first part 8*a* of retaining apparatus 8. When an organized sheet stack 3 has built up, stop gap closure element 16 is introduced into the region between guide element 18 and the joining point between first 8*a* and second part 8*b* of retaining apparatus 8. Sheets that have just been fed in must overcome the downward force of retaining apparatus 8 in order to be aligned against sheet stop 6. A stopgap 15 is configured in the region behind jogger wheel 12 and in front of second part 8*b* of retaining apparatus 8. Stopgap closure element 16 thus prevents freshly fed sheets from buckling excessively in stopgap 15 and possibly being damaged or causing a paper jam. The situation without stop gap closure element 16 is depicted in FIG. 1 with dashed lines. Freshly fed sheets 5 are transported by the feed of jogger wheel 12, and against the downward force of retaining apparatus 8, toward sheet stop 6. Arching 7 (illustrated by dashed lines) of the freshly fed sheets in stopgap 15 is consequently unavoidable without a stopgap closure element 18**.

FIG. 2 shows the situation in which an organized sheet stack 3 has been removed form collector bin 2. During removal of the sheet stack, holding element 14 rotates clockwise independently of jogger wheel 12. Stop finger 10 is thereby lowered onto sheet support 4, and the fed sheets are collected at stop finger 10. At the same time, stopgap closure element 16 is withdrawn out of stop gap 15 by clockwise rotation of holding element 14. Once the organized stack has been fully removed, holding element 14 rotates counter-clockwise about shaft A. Stop finger 10 thus withdraws out of the paper path, while at the same time stopgap closure element 16 is slid into stopgap 15.

The invention has been described with respect to an embodiment, but it lies within the context of the mechanical skill of a person skilled in the art to make modifications, without thereby leaving the scope of the claims below.

List of reference symbols:

| | |
|---|---|
| 2 | Collector bin |
| 3 | Sheet stack |
| 4 | Sheet support |
| 5 | Fed sheets |
| 6 | Sheet stop |

-continued

| | |
|---|---|
| 7 | Arching |
| 8 | Retaining apparatus |
| 8a | First part of retaining apparatus |
| 8b | Second part of retaining apparatus |
| 10 | Stop finger |
| 12 | Jogger wheel |
| 14 | Holding element |
| 15 | Stopgap |
| 16 | Stopgap closure element |
| 18 | Guide element |
| 20 | Retainer |
| 22 | Mounting element |
| 24 | Slot A |
| A | Shaft |

We claim:

1. Apparatus for stacking individually fed sheets (5), comprising a collector bin (2) for the fed sheets (5) that is made up of a sheet support (4) and a sheet stop (6), a retaining apparatus (8) for the fed sheets (5) arranged facing the sheet support (4), and a stop finger (10) that can be pivoted into the paper path, characterized in that a jogger wheel (12), with which the fed sheets (5) can be transported toward said sheet stop (6), is installed above said sheet support (4) rotatably about a shaft (A); and that a holding element (14) for said stop finger (10) can be moved on the shaft (A) independently of the rotary movement of said jogger wheel (12); and that a stopgap closure element (16) is also arranged on said holding element (14) in such a way that said stop finger (10) or said stopgap closure element (16) can be introduced into the paper path.

2. Sheet stacking apparatus according to claim 1, characterized in that said retaining apparatus (8) includes a first part (**8*a*) and a second part (8*b*), said first part (8*a*) being arranged parallel to the sheet support (4) and said second part (8*b*) being shaped onto the end of said first part (8*a*) facing away from said sheet stop (6) in such a way that said second part (8*b*) forms an acute angle $\alpha$ with said sheet support (4**).

3. Sheet stacking apparatus according to claim 2, characterized in that said retaining apparatus (8) is mounted movably in a mounting element (22) in such a way that said retaining apparatus (8) can be moved, as a function of the height of an organized stack (3), vertically away from said sheet support (4) or toward said sheet support (4).

4. Sheet stacking apparatus according to claim 1, characterized in that there is provided for said stopgap closure element (16), a guide element (18) that is attached in stationary fashion and is inclined slightly with respect to said sheet support (4) in such a way that said stopgap closure element (16) can be moved or introduced into a stopgap (15), by counter-clockwise rotation of said holding element (14), with a slight inclination with respect to the sheet stack (3) located on said sheet support (4).

5. Sheet stacking apparatus according to claim 4, characterized in that said stopgap closure element (16) can be introduced into the region between said guide element (18) and the end of said first part (**8*a*) of the retaining apparatus (8) located opposite to said sheet stop (6), in such a way that excessive arching (7) of the sheets (5) just fed in is prevented by said stopgap closure element (16**).

6. Sheet stacking apparatus according to claim 5, characterized in that said stopgap closure element (16) is a leaf spring.

* * * * *